US006402349B1

(12) United States Patent
Miller et al.

(10) Patent No.: US 6,402,349 B1
(45) Date of Patent: Jun. 11, 2002

(54) DUAL LIGHTING LENS PANEL

(76) Inventors: Jack V. Miller; Ruth E. Miller, both of 20961 Sussex Hwy. 13, Seaford, DE (US) 19973

( * ) Notice: Subject to any disclaimer, the term of this patent is extended or adjusted under 35 U.S.C. 154(b) by 0 days.

(21) Appl. No.: 09/917,518

(22) Filed: Jul. 30, 2001

(51) Int. Cl.[7] ..... F21S 8/04
(52) U.S. Cl. ..... 362/331; 362/223; 362/148
(58) Field of Search ..... 362/330, 331, 362/222, 223, 147, 148

(56) References Cited

U.S. PATENT DOCUMENTS 3,117,729 A * 1/1964 Silvers et al. ..... 362/222
5,025,349 A * 6/1991 Gow ..... 362/147
5,791,764 A * 8/1998 Jaksich ..... 362/223
5,863,114 A * 1/1999 Nagatani et al. ..... 362/331

* cited by examiner

*Primary Examiner*—Laura K. Tso

(57) ABSTRACT

A dual-surface lens for light fixtures and T-bar ceilings includes a first lens panel having a planar perimeter around a decorative or optical control area and a second lens panel having a planar perimeter resting on the planar perimeter of the first lens panel. In a preferred embodiment the first lens panel depends below the planar perimeter and the second lens panel extends above the planar perimeter at an angle of from 5° to 15°.

5 Claims, 2 Drawing Sheets

DUAL LIGHTING LENS PANEL

BACKGROUND OF THE INVENTION

This invention applies to the field of light fixture lenses and more particularly to the square or rectangular lens panels used as diffusers on fluorescent light fixtures. Such lenses are often installed into recessed or surface-mounted fluorescent light fixtures, or are made to rest on the flanges of the T-bar grid openings that are illuminated from above.

DESCRIPTION OF THE PRIOR ART

Some prior art light fixture lenses are simply white opal translucent plastic sheets or prismatic light control patterns. All such prior art lenses have three short-comings.

First, all fluorescent lamps emit significant UV (ultraviolet radiation) that is harmful to humans, as well as damaging to photosensitive materials, such as textiles, documents and other organic materials. Most prior-art fluorescent lenses do not have enough thickness to stop such radiation.

Second, all fluorescent lamps emit significant IR (infrared radiation) that is uncomfortable to humans, as well as damaging to heat sensitive materials, such as paintings, painted wood, animal specimens and other organic materials that are subject to being dried out. Most prior-art fluorescent lenses do not have enough thickness to stop such radiation.

Third, prior-art lenses tend to accumulate internal dirt and dead insects that are attracted to the light and remain trapped in the fixture until they die and fall onto the inner surface of the lenses, making the fixtures look dirty and unsightly.

PURPOSE OF THE PRESENT INVENTION

The first purpose of the present invention is to provide a lighting lens capable of blocking UV radiation. The second purpose of the invention is to provide a lighting lens capable of blocking IR radiation. The third purpose of the invention is to provide a lens in which trapped debris particles and dead insects are not visible.

BRIEF DESCRIPTION OF THE INVENTION

The foregoing purposes are achieved by a dual-surface lens for light fixtures and T-bar ceilings in which a first lens panel has a planar perimeter around a central area of decorative or optical control and a second lens panel has a planar perimeter resting on the planar perimeter of the first lens panel. In a preferred embodiment the central area of the first lens panel is flush with or depending below the planar perimeter and the second lens panel is pyramidal and extending above the planar perimeter at an angle of 5° to 15°.

REFERENCE NUMERALS IN THE DRAWINGS

| | |
|---|---|
| 1 prismatic lens | 2 fluorescent fixture flange |
| 3 fluorescent light fixture | 4 insects |
| 5 debris | 6 fluorescent lamp |
| 8 decorative embossed lens | 9 T-bar flanges |
| 10 T-bar | 12 fluorescent lamp |
| 15 dual-surface lens | 16 first lens panel |
| 17 first lens perimeter | 18 light fixture flanges |
| 19 optical control area | 20 fluorescent lighting fixture |
| 21 perimeter of second lens | 22 raised pyramid area |
| 23 pyramid peak | 24 second lens panel |
| 26 first lens panel | 27 planar perimeter |
| 29 T-bar flange | 30 T-bars |
| 32 bonding | 35 fasteners |

DETAILED DESCRIPTION OF THE DRAWINGS

Figure 1:
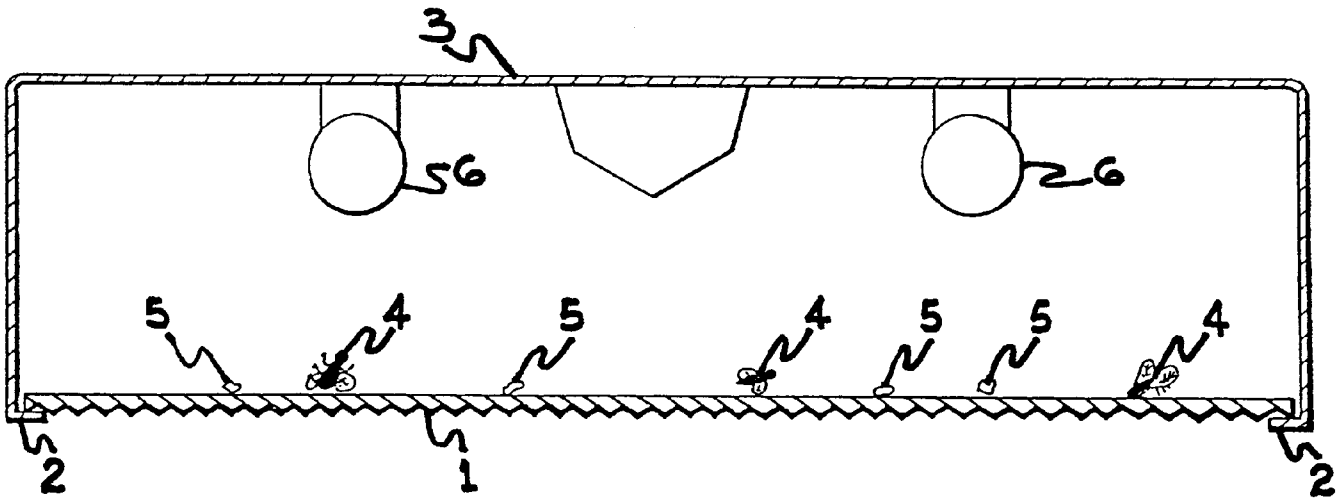
FIG. 1 (PRIOR ART)
FIG. 1 is a cross-sectional elevation view of a prior-art lens, shown in a typical fluorescent light fixture with a flat, prismatic lens.

In FIG. 1 a prior art prismatic lens 1 is shown installed on flanges 2 of a fluorescent light fixture 3. Insects 4 and debris particles 5 have found their way into the fixture are clearly visible on the lens, normally right under lamps 6.

Figure 2:
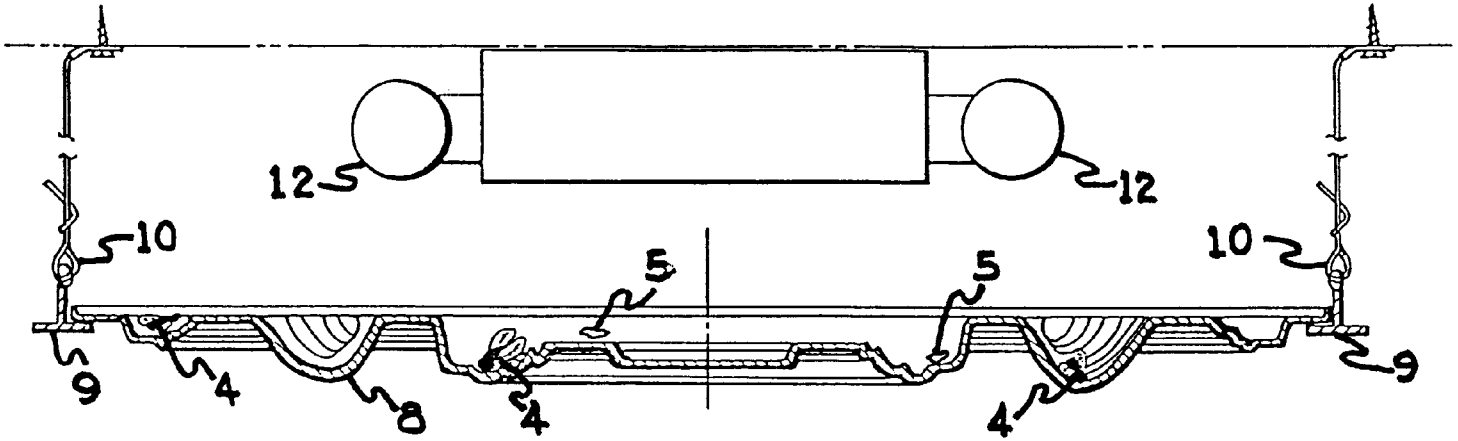
FIG. 2 (PRIOR ART)
FIG. 2 is a cross-sectional elevation view of a prior-art lens, shown in a typical T-bar suspended ceiling, with a sculpted, decorative lens.

In FIG. 2 a prior art decorative embossed lens 8 is shown installed on flanges 9 of suspended ceiling T-bars 10 under fluorescent lamps 12. Insects 4 and debris particles 5 have found their way onto the lens, normally right under lamps 12.

Figure 3:
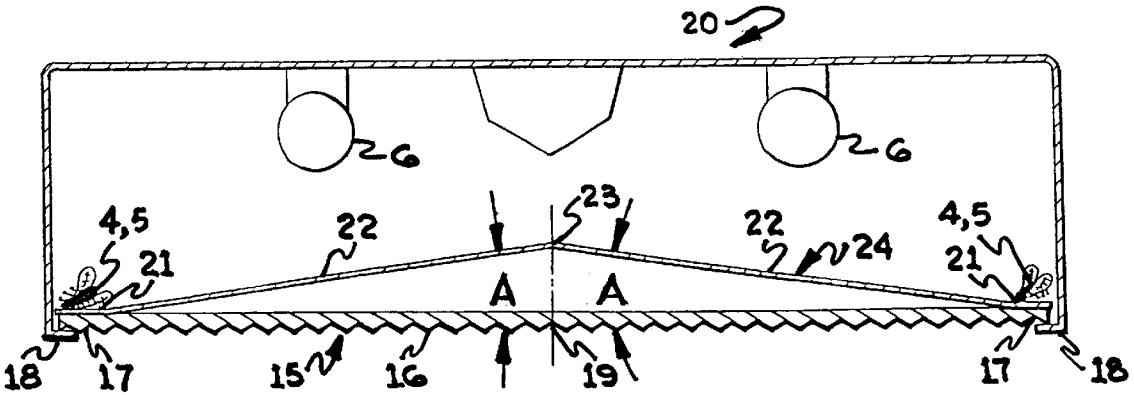
FIG. 3 is a cross-sectional elevation view of a prior-art lens, shown in a typical fluorescent light fixture with a flat, prismatic lens.

In FIG. 3 a dual-surface lens 15 is shown having a first lens panel 16 having a planar perimeter 17 adapted to rest on a flanges 18 of a light fixture 20, said planar perimeter enclosing an optical control area 19. A second lens panel 24 has a planar perimeter 21 adapted to rest on the planar perimeter 17 of the first lens panel. Said second lens panel planar perimeter 21 encloses a raised pyramid area 22 with a central peak 23 and edges contiguous with the planar perimeter 21. Pyramid area 22 may be comprised of any clear or translucent diffusing material common in the lighting industry. Insects 4 and debris particles 5 have found their way onto the lens, normally right under lamps 6. However, the pyramid area, having angle "A" slope angles from 5° to 15° between the peak 23 and the perimeter 17, causes insects 4 and debris particles 5 to migrate to the perimeter 17. The migration is facilitated by the buzzing of dying insects and natural ballast and ceiling vibrations. The result is that the insects and debris end up out if sight.

Figure 4:
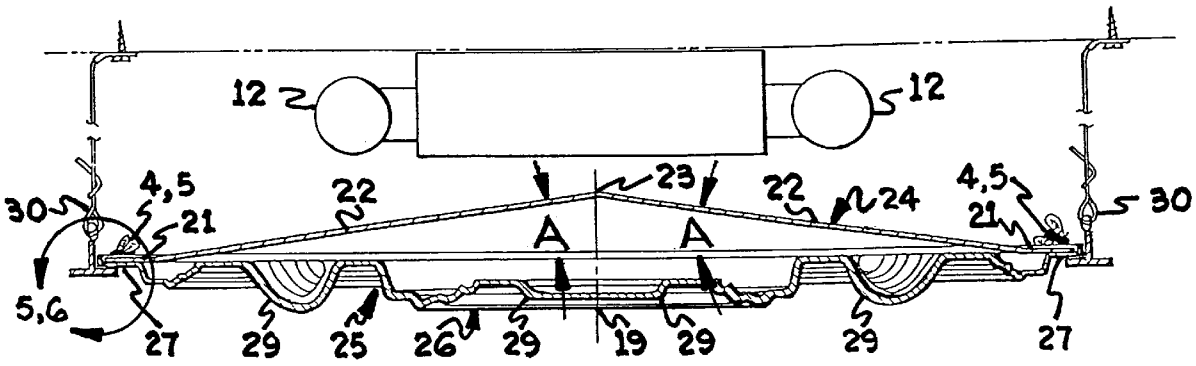
FIG. 4 is a cross-sectional elevation view of a prior-art lens, shown in a typical T-bar suspended ceiling, with a sculpted, decorative lens.

In FIG. 4 a dual-surface lens 25 is shown having a first lens panel 26 having a planar perimeter 27 adapted to rest on a flanges 29 of suspended ceiling T-bars 30. The lenses are illuminated by ceiling-mounted fluorescent lamps 12. Planar perimeter 27 encloses an optical control area 26 having depending decorative patterns 29. A second lens panel 24 is identical to panel 24 of FIG. 3, having a planar perimeter 21 adapted to rest on the planar perimeter 27 of the first lens panel 26. Second lens planar perimeter 21 encloses a raised pyramid area 22 with a central peak 23 and edges contiguous with the planar perimeter 27 of first lens 26. The pyramid area 22 may be comprised of any clear or translucent diffusing material common in the lighting industry. Insects 4 and dirt particles 5 may find their way onto the lens, normally right under a lamp 12. However, the pyramid area 22, having angle "A" slope angles from 5° to 15° between the peak 22 and the perimeter 21, causes insects 4 and dirt particles 5 to migrate to the perimeter 21. The migration is facilitated by the buzzing of dying insects and natural ballast and ceiling vibrations. The result is that the insects and debris do not remain under the lamps, but end up out if sight on the perimeter 21 of the second lens 24.

Figure 5:
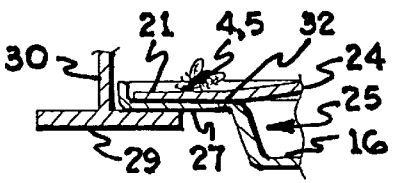
FIG. 5 is an enlarged cross-sectional elevation view of detail 5 of FIG. 4, showing a preferred embodiment of the invention.

In FIG. 5 a dual-surface lens 25 is shown having a first lens panel 26 attached to second lens panel 24 with bonding 32 selected from the group including solvent adhesive bonding, thermal bonding, double-sided adhesive tape. This forms a rigid hollow structure that prevents the lens from bending or warping in service.

Figure 6:
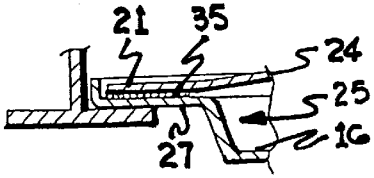
FIG. 6 is an enlarged cross-sectional elevation view of a second preferred embodiment of the invention

In FIG. 6 dual-surface lens 25 is shown having a first lens panel 26 attached to second lens panel 24 with fasteners 35 selected from the group including integral snap fasteners and hook-and-loop fasteners.

Lens material thicknesses of lenses 16 and 26 are usually insufficient to stop al UV and IR from lamps, but they are economical to form in complex patterns. However, the simple shape of the pyramidal second lens panel may be made of thicker material to better absorb UV and IR.

SUMMARY, RAMIFICATIONS AND SCOPE

The purposes of the present invention are achieved and in practice provides a practical and inexpensive method for a flat, rigid lens capable of filtering UV and IR out of the transmitted light and causing Insects and debris particles to migrate to the perimeter of a lighting and end up out if sight. I will be obvious to anyone skilled in the art to employ other shapes and angles that will perform the same functions within the scope and spirit of the present invention.

What is claimed is:

1. A dual-surface lens (15, 25) for light fixtures and T-bar ceilings including:

a first lens panel (16, 26) having a planar perimeter (17, 27) adapted to rest on a light fixture flange (18) or T-bar ceiling flange (29), said planar perimeter enclosing a decorative or optical control area (16, 29); and a second lens panel (24 ) having a planar perimeter (21) adapted to rest on the planar perimeter (17, 27) of the first lens panel, said second lens panel planar perimeter enclosing a raised pyramid area (22) with a central peak (23) and edges contiguous with the planar perimeter (21), said pyramid area comprising clear or translucent diffusing material.

2. A dual-surface lens for light fixtures and T-bar ceilings according to claim 1 in which the second lens panel pyramid has sides (22) extending from the perimeter flange (21) to the peak (23) at an angle from 5° to 15°.

3. A dual-surface lens for light fixtures and T-bar ceilings according to claim 1 in which the first lens panel (16) optical or control area (19) is selected from the group including clear or translucent prismatic or irregular patterns.

4. A dual-surface lens for light fixtures and T-bar ceilings according to claim 1 in which the first (16, 26) and second (24) lens panels are joined together with fasteners (32, 35) selected from the group including solvent adhesive bonding, thermal bonding, double-sided adhesive tape, integral snap fasteners and hook-and-loop fasteners.

5. A dual-surface lens for light fixtures and T-bar ceilings according to claim 1 in which the second lens panel (24) pyramid area (22) is generally polygonal.

* * * * *